US011384603B1

(12) United States Patent
Simanowski

(10) Patent No.: US 11,384,603 B1
(45) Date of Patent: Jul. 12, 2022

(54) ROTATIONAL VIBRATION ABSORBER WITH TANGENTIAL DAMPERS CAP

(71) Applicant: Scientific Drilling International, Inc., Houston, TX (US)

(72) Inventor: Mario Simanowski, Meinersen (DE)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 0 days.

(21) Appl. No.: 17/128,035

(22) Filed: Dec. 19, 2020

(51) Int. Cl.
*E21B 12/00* (2006.01)
*E21B 41/00* (2006.01)
*E21B 11/00* (2006.01)

(52) U.S. Cl.
CPC ..... *E21B 12/00* (2013.01); *E21B 11/00* (2013.01)

(58) Field of Classification Search
CPC ..... E21B 17/07; E21B 7/24; E21B 47/017; E21B 28/00; E21B 41/00; E21B 12/00
See application file for complete search history.

(56) References Cited

U.S. PATENT DOCUMENTS

2012/0228028 A1* 9/2012 Turner ..... E21B 44/00 175/56
2015/0259989 A1* 9/2015 Gajji ..... E21B 19/24 175/56

* cited by examiner

*Primary Examiner* — Robert E Fuller
(74) *Attorney, Agent, or Firm* — Ewing & Jones, PLLC

(57) ABSTRACT

A vibration damping device for use with a downhole tool having a tool axis may comprise a body coupled to a drill string component. The body may include a longitudinal bore therethrough and at least one lateral bore, the lateral bore having a bore opening and an end wall; an inertial mass slidably disposed in the lateral bore; and a cap mechanically coupled to the lateral bore. The lateral bore may be orthogonal to a radius of the body and may lie in a plane normal to the tool axis. The body may include a plurality of lateral bores, which may be in a co-planar arrangement. Each lateral bore may be blind hole positioned in the body so that it does not intersect the longitudinal bore or another lateral bore. A cap may enclose a lateral bore and fluid may be contained in the bore by the cap.

15 Claims, 10 Drawing Sheets

ROTATIONAL VIBRATION ABSORBER WITH TANGENTIAL DAMPERS CAP

CROSS REFERENCE TO RELATED APPLICATIONS

None.

TECHNICAL FIELD/FIELD OF THE DISCLOSURE

The present disclosure relates generally to damping vibrations or rotational oscillations during drilling operations using rotary steerable systems, and specifically to inertial damping systems converting vibration energy into heat energy, resulting in the desired damping effect.

BACKGROUND OF THE DISCLOSURE

In hydrocarbon drilling operations, boreholes are typically drilled by rotating a drill bit attached to the end of a drill string. The drill bit can be rotated by rotating the drill string at the surface and/or by a fluid-driven downhole mud motor, which may be part of a bottom hole assembly (BHA). For example, a mud motor may be used when directional drilling using a rotary steerable system (RSS). The combination of forces and moments applied by the drill string and/or mud motor and forces and moments resulting from the interaction of the drill bit with the formation can have undesirable effects on the drilling system, including reducing the effectiveness of the cutting action, damage to BHA components, reduction in BHA components' life, and interference in measuring various drilling parameters.

SUMMARY

To mitigate such negative effects, a BHA may be equipped with a damping system to draw vibration energy from the BHA and thereby damping the effects associated with torsional vibration excitation. A vibration damping device may be used with and adapted for use with a downhole tool. The downhole tool may have a tool axis and may include a drill string component.

A vibration damping device may comprise a body integral with or mechanically coupled to the drill string component, an inertial mass slidably disposed in the lateral bore, and a cap mechanically coupled to the lateral bore. The body may include a longitudinal bore therethrough and at least one lateral bore, the lateral bore having a bore opening and an end wall. The lateral bore may be orthogonal to a radius of the body and lies in a plane normal to the tool axis. The body may include a plurality of lateral bores in a co-planar arrangement or a plurality of co-planar arrangements. Each lateral bore may be a blind hole and may be positioned in the body so that it does not intersect the longitudinal bore or another lateral bore. The cap may enclose the bore opening.

The device may further include a first biasing means positioned between one end of the inertial mass and the lateral bore and a second biasing means positioned between another end of the inertial mass and the cap. The lateral bore may be a stepped hole comprising a first bore section and a second bore section. The second bore section may define the inner end of the lateral bore and may have a smaller diameter than the first bore section, and one end of the first biasing means may be disposed in the second bore section.

The cap and the lateral bore may define a bore chamber and a portion of the bore chamber that is not occupied by the inertial mass may be occupied by a liquid. The device may further include a cartridge housing disposed in and mechanically coupled to the lateral bore. The cap may enclose the cartridge housing and define a bore chamber therewith, and the inertial mass may be slidably disposed in the bore chamber. The device may further include a first biasing means positioned between one end of the inertial mass and the cartridge and a second biasing means positioned between another end of the inertial mass and the cap.

A portion of the bore chamber not occupied by the inertial mass may be occupied by a liquid. The inertial mass may include at least one fluid passage therethrough. Each lateral bore may further include a fluid-filled piston chamber and each inertial mass may include a piston extending into the piston chamber. The piston may include fluid orifices therethrough such that as the piston reciprocates within the piston chamber, fluid in the piston chamber flows through the orifices. The fluid in the piston chamber may be the same or different from the fluid in the bore chamber.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
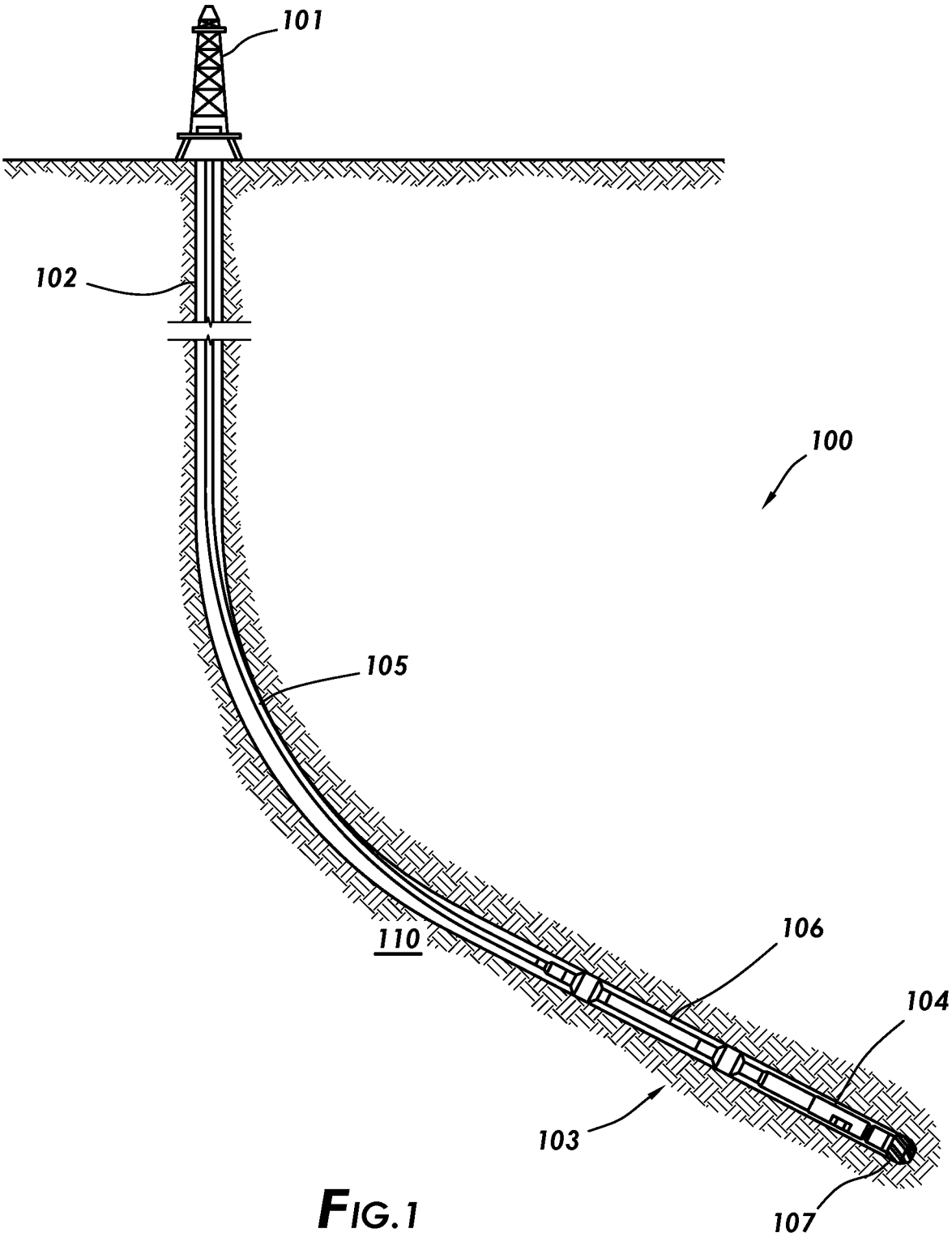
FIG. 1 is a schematic view of a drilling system in which embodiments of the current invention can be used.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

The present disclosure hereby includes the concepts and features described in U.S. Application Ser. No. 62/952,233, filed Dec. 21, 2019 and entitled "Method and Apparatus for Damping/Absorbing Rotational Vibrations/Oscillations," and U.S. Application Ser. No. 62/976,898, filed Feb. 14, 2020 and entitled "Method and Apparatus for Damping/Absorbing Rotational Vibrations/Oscillations," each of which is hereby incorporated herein in its entirety.

Referring initially to FIG. 1, a drilling system 100 in which the present apparatus may be used may include a drilling rig 101 positioned above a wellbore 102 that extends into a subsurface formation 110. A drill string 105 may extend from drilling rig 101 into wellbore 102 and may terminate in a bottom hole assembly (BHA) 103. Drill string 105 may be driven by the surface equipment of the rig. In some embodiments, BHA 103 may include a drill bit 107, a motor 106, which may be a mud motor or other downhole motor, and a steerable system 104, which may be a rotary steerable system (RSS). BHA 103 may optionally include various other devices, such as logging or measurement devices, communications devices, and the like. If present, steerable system 104 may be used to steer the bit as the wellbore is drilled. The rotational force (torque) required to rotate drill bit 107 can be provided by a torque creating or applying apparatus, which may be a drill string 105, motor 106, or a combination thereof.

Figure 2:
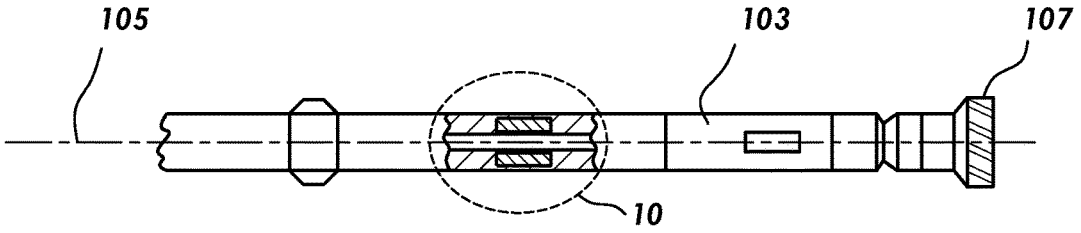
FIGS. 2-4 schematically illustrate possible locations for a damping device and its different setups for installation in a drilling system.
Figure 3:
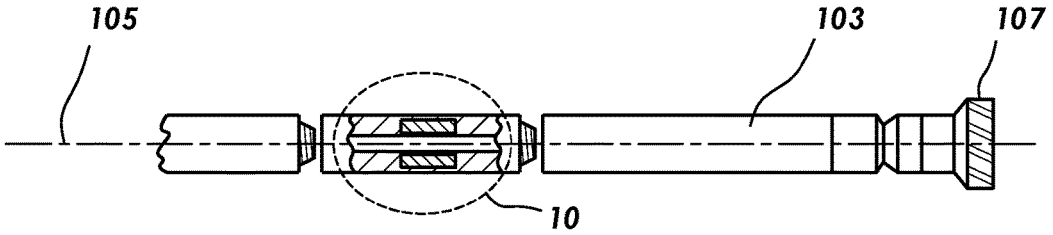
Figure 4:
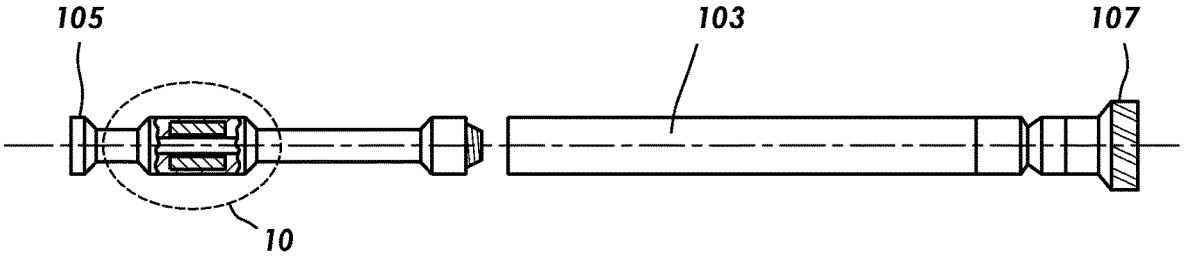

According to FIGS. 2-4, in some embodiments, one or more damping devices 10 may be positioned between the torque applying or creating apparatus and drill bit 107. By way of example only, a damping device 10 may be positioned between drill string 105 and drill bit 107 or between steerable system 104 and drill bit 107. Alternatively or additionally, a damping device may be part of the drill bit. In FIG. 2, damping device 10 is integrated in BHA 103. In FIG. 3, damping device 10 is provided on one or more standalone subs as an add-on to BHA 103. FIG. 3 shows a "modular" device, in which the functional features can be selectively added or removed at a rigsite. FIG. 4 shows a setup in which the functional features are integrated into a different component of the BHA (e.g. a stabilizer or a flex sub). If the damping device is included (integrated) in the BHA, adding or removing the damping device at the rigsite is only possible if the entire BHA component is added or removed. The optimal position of the damping device depends on a multitude of parameters. Optimal efficacy is reached when placed at an anti-node of the respective modal-shape.

Figure 5:
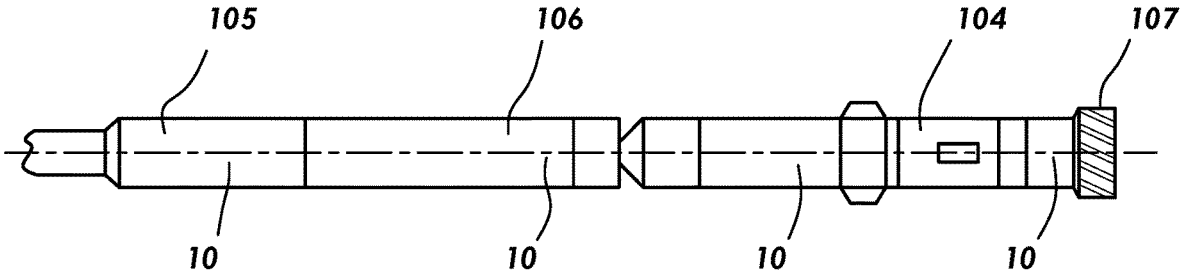
FIGS. 5-7 schematically illustrate additional possible locations for a damping device and its different setups for installation in a drilling system.
Figure 6:
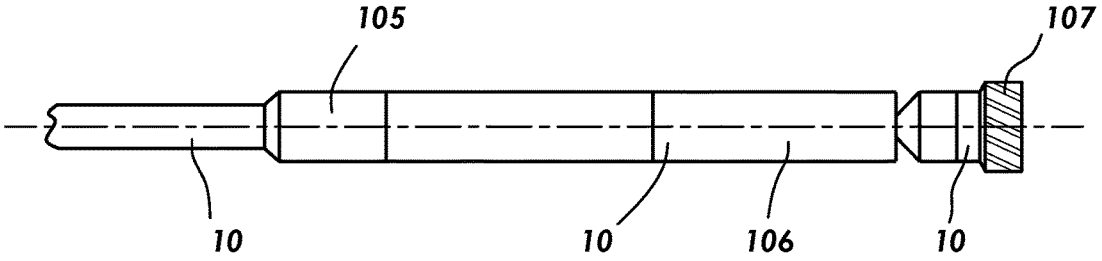
Figure 7:
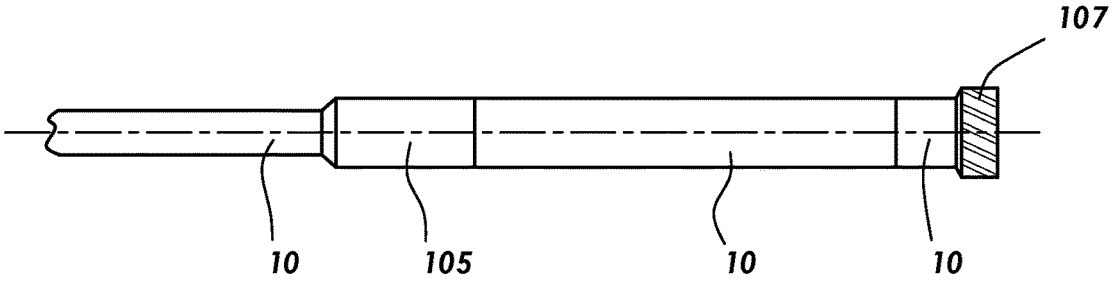

The damping device may be part of any BHA component. FIGS. 5-7 show various possible locations for the damping device 10 in the drillstring. Specifically, FIG. 5 shows several possible locations for the damping device 10 on a motor driven RSS BHA. FIG. 6 shows several possible locations for damping device 10 on a conventional motor driven BHA. FIG. 7 shows several possible locations for damping device 10 on a conventional BHA without motor and RSS.

Figure 8:
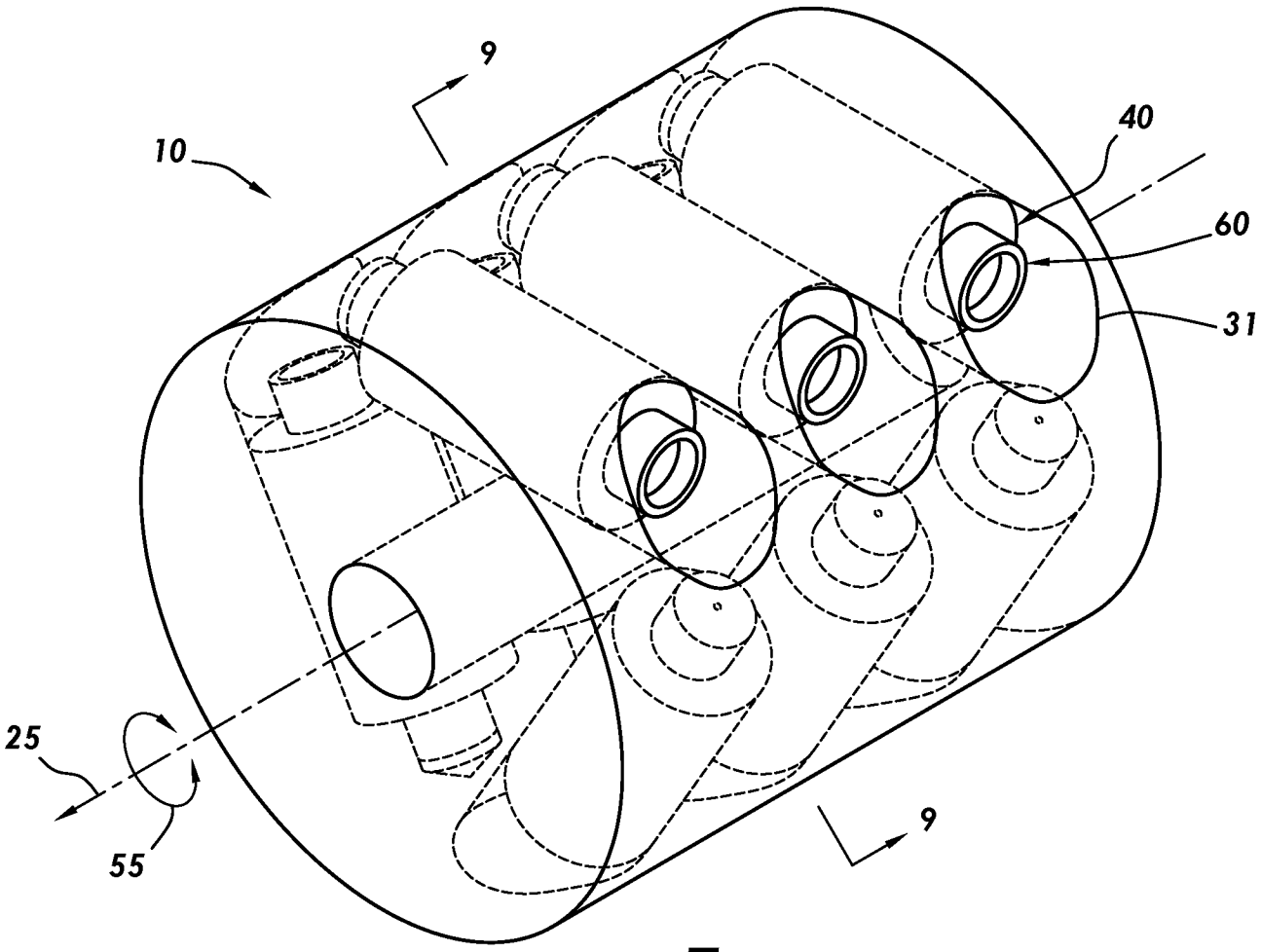
FIG. 8 is a view of a device in accordance with an embodiment of the invention.
Figure 9:
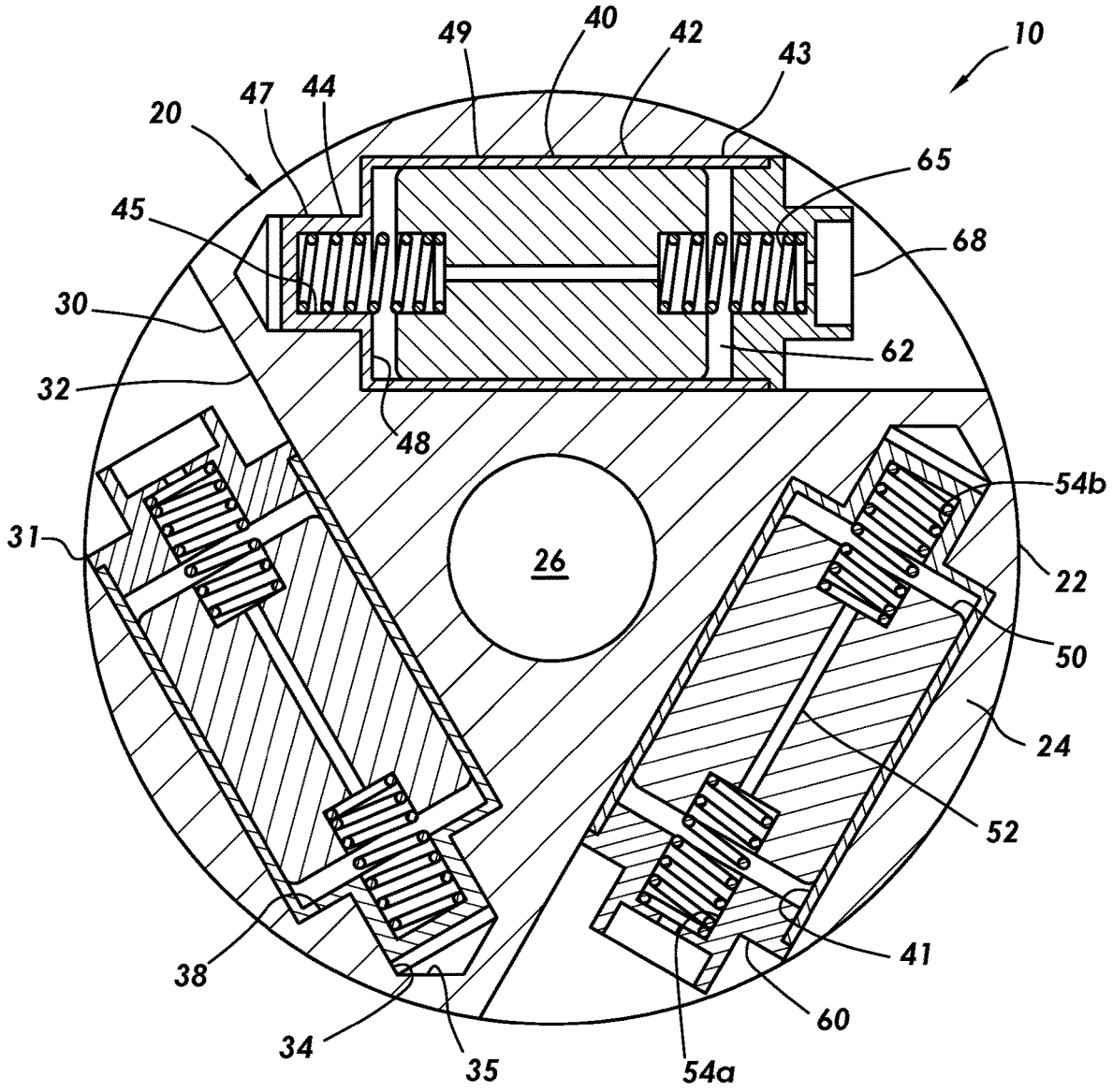
FIG. 9 is cross-section along lines 9-9 of FIG. 8.

Referring now to FIGS. 8 and 9, some embodiments of the present damping device 10 may comprise a body 20 and at least one energy-absorbing damping cartridge 40 disposed therein. Body 20 is generally cylindrical and has an outer surface 22, wall 24, longitudinal axis 25, and central bore 26. Body 20 may form a portion of drill string 105 or may be mechanically coupled to or integral with drill string 105 such that rotational vibrations of the drill string 105 are transmitted to body 20.

Body 20 may include at least one lateral bore 30 extending from outer surface 22 of body 20 into wall 24. In some embodiments, each lateral bore 30 may be orthogonal to a radius of body 20 and lie in a plane normal to longitudinal axis 25. In some embodiments, body 20 may include a plurality of bores 30 located in a plane, i.e. at the same point along the longitudinal axis of body 20 and may include a plurality of such co-planar arrangements. In the embodiment shown in FIG. 8, body 20 includes three sets of three co-planar bores.

As best illustrated in FIG. 9, each bore may be a blind hole and may be positioned in body 20 so that it does not intersect central bore 26 or another lateral bore. Each lateral bore 30 has an opening 31 and may be formed in body 20 by any suitable method, including but not limited to casting or machining. In some embodiments, each lateral bore 30 may be a stepped hole, having a first bore section 32 and a second bore section 34. Second bore section 34 defines the inner end of lateral bore 30 and has a smaller diameter than the first bore section 32. Each bore may also include a countersink 35. Opposite the opening 31 lateral bore 30 has an end wall 38. If lateral bore 30 is a stepped hole, end wall 38 may be defined at the interface of first and second bore sections 32, 34.

In some embodiments, a damping cartridge 40 may be received in and mechanically coupled to each lateral bore 30. Each damping cartridge 40 may be retained in its respective bore 30 by any suitable means, including but not limited to friction, adhesive, set screws, and/or threads. Damping cartridge 40 may include a cartridge housing 49 having a first body section 42 and a second body section 44 having a smaller diameter than the first body section 42. Second body section 44 is adjacent to first body section 42 and a shoulder 48 is defined at the interface of first and second body sections 42, 44. First body section 42 may have inner and outer surfaces 41, 43, respectively. In some embodiments, first body section 42 may be sized such that outer surface 43 forms a friction fit with first bore section 32 of lateral bore 30. Similarly, second body section 44 may have inner and outer surfaces 45, 47, respectively. In some embodiments, second body section 44 may be sized such that outer surface 47 forms a friction fit with second bore section 34 of lateral bore 30. Damping cartridge 40 may be positioned in lateral bore 30 so that first body section 42 is disposed with first bore section 32, second body section 44 is disposed with second bore section 34, and shoulder 48 abuts end wall 38.

Damping device 10 may further include a cap 60 affixed to and enclosing cartridge housing 49. Together, cartridge housing 49 and cap 60 define a bore chamber 62.

Still referring to FIG. 9, each damping cartridge 40 may also include an inertial mass 50 slidably disposed in first body section 42 of cartridge housing 49. Inertial mass 50 may include one or more fluid passages 52 therethrough and may have a longitudinal dimension that is less than the longitudinal dimension of first body section 42, so as to allow inertial mass 50 to shift longitudinally within cartridge housing 49. Shifting may be the result of alternating forces applied to damping cartridge 40 as a result of rotational vibration of damping device 10 as illustrated at arrow 55 in FIG. 8. In some embodiments, one or more energy-storing and/or energy-absorbing biasing members may be positioned between the ends of inertial mass 50 and the ends of bore chamber 62. In the embodiment illustrated in FIG. 9, each end of inertial mass 50 includes a recess 54*a*, 54*b*. A coil spring 65 is positioned in each recess and serves as a biasing member. One coil spring extends from recess 54*a* into second body section 44 and the other coil spring extends from recess 54*b* into a corresponding recess in cap 60.

The portion of each bore chamber 62 that is not occupied by inertial mass 50 or optional elastomeric members may be occupied by a damping fluid and/or one or more elastomeric members. The fluid may be a specifically selected damping fluid, such as a viscous medium including, for example, silicone oil. The damping fluid may have a high viscosity, such as for example up to 1,000,000 cSt at 25° C. In some embodiments, body 20, inertial mass 50, and/or cap 60 may include ports and/or channels (not shown) for evacuating or filling chambers 62, 82 and/or 83 with damping fluid. Such damping fluid and/or elastomeric members may absorb energy from the movement of inertial mass 50 and dissipate it as heat. In some embodiments, inertial mass 50 may comprise multiple stacked pieces arranged within first body section 42. In other embodiments, inertial mass 50 may include one or more surface features, such as fins, that serve to resist movement of inertial mass 50 through a fluid.

In some embodiments, a volume compensation element 68 may be included in bore chamber 62. The damping fluid may expand and contract, depending on surrounding pressure and temperature. To allow an equalization of pressure between bore chamber 62 and the annulus, the volume needs to adapt. Volume compensation element 68 may comprise a compressible elastomeric element, variable-volume gas-containing enclosed chamber, volume-adjusting piston, or any other suitable device.

Figure 10A:
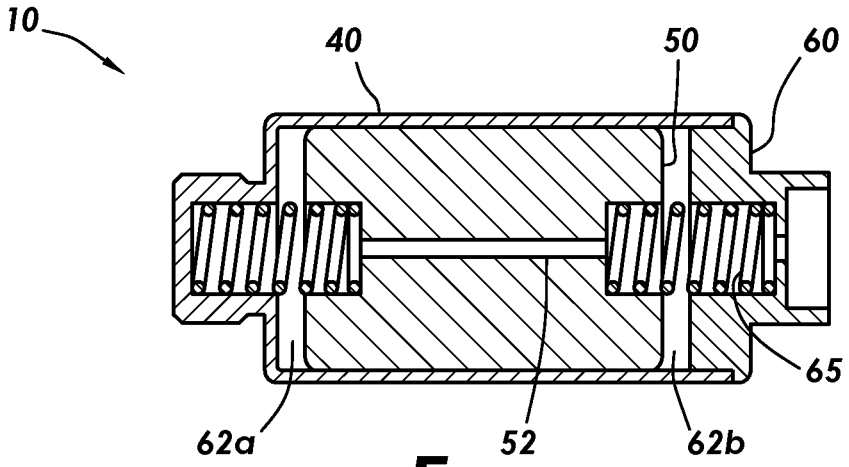
FIGS. 10A-C are three cross-sectional views of a component of a device in accordance with an alternative embodiment of the invention, showing the component in three different operating positions (neutral, maximum right, maximum left).
Figure 10B:
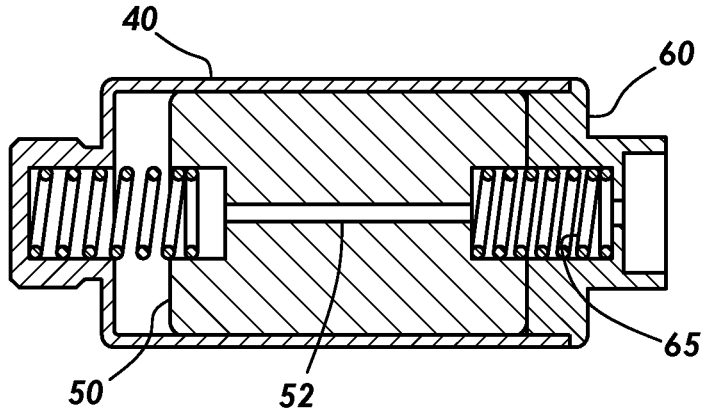
Figure 10C:
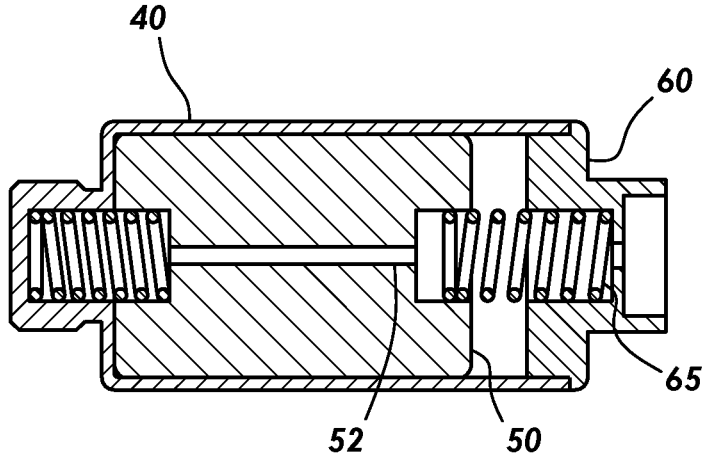

Referring now to FIGS. 10A-C, the operation of damping device 10 is illustrated. As the drill string rotates in the borehole, such as during drilling, it may be subject to rotational vibrations, indicated by arrow 55 in FIG. 8. The rotational vibrations may cause inertial mass 50 to oscillate between positions within damping cartridge 40. In FIG. 10A, inertial mass 50 is in a neutral position. In FIG. 10B, inertial mass 50 has shifted to the right (as drawn), and in FIG. 10C, inertial mass 50 has shifted to the left (as drawn). Movement of inertial mass 50 within damping cartridge 40 may be limited by more energy-storing and/or energy-absorbing members such as springs 65, if present or by contact with shoulder 48 and cap 60. Movement of inertial mass 50 within damping cartridge 40 changes the relative volumes of first and second chamber portions 62*a*, 62*b*. The resulting pressure differential causes fluid to flow from whichever chamber portion is shrinking through fluid passage 52 to the chamber portion that is expanding. In addition to fluid passage 52, fluid may also flow between chamber portions between inertial mass 50 and inner surface 41 of cartridge housing 49. During oscillation, fluid may flow back and forth between first and second chamber portions 62*a*, 62*b*. Friction within the fluid and between the fluid and the solid components of damping device 10 converts some of the vibrational energy into heat, thereby damping the oscillation.

In some instances, it may be desired to include one or more adjustable flow restrictors in one or more of the fluid flow paths. Higher restriction causes higher damping and a stiffer characteristic. The desired damping characteristic may be tunable and may require an adjustment of one or more factors including but not limited to restriction, fluid viscosity, spring stiffness, inertia, and the like. In some embodiments, it may be desirable to provide a magnetorheological fluid in each bore chamber 62 and to adjust the properties of the magnetorheological fluid by applying a variable magnetic field across all or a portion of damping device 10.

In some embodiments, all or a portion of one or more bore chambers 62 may be also occupied by an elastomer or one or more elastomeric bodies. The elastomer may have specific elastic and damping properties so that it can deform and dissipate energy while deforming. For both choices (a high viscosity fluid and an elastomer) it is required that the molecular chains of the material move relative to each other so as to dissipate energy.

Figure 11:
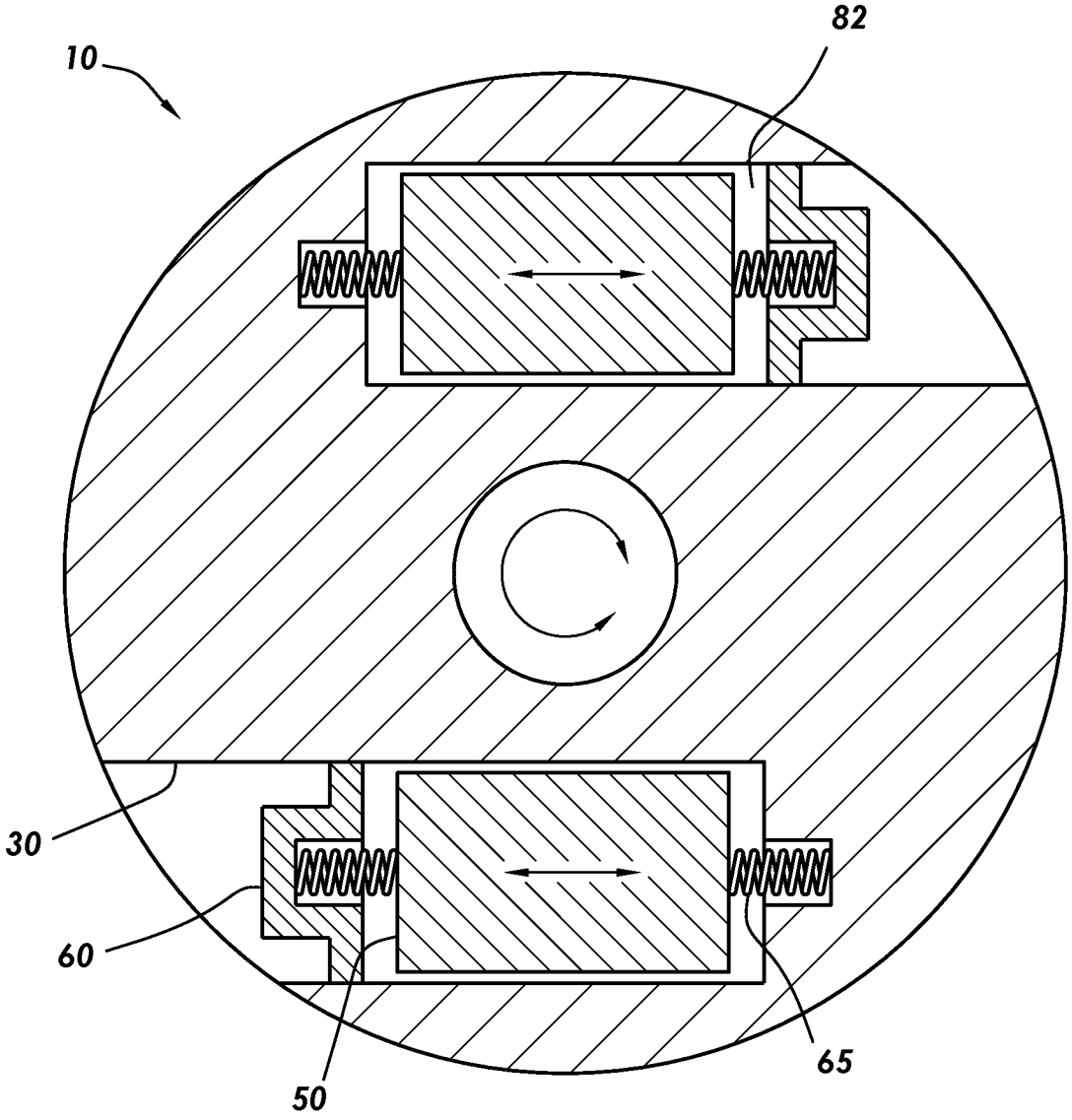
FIG. 11 is cross-section of a device in accordance with an alternative embodiment of the invention.

Referring now to FIG. 11, an alternative embodiment is illustrated, in which each co-planar set of damping cartridges comprises two, instead of three damping cartridges. Further, in the embodiment of FIG. 11, cartridges 40 are omitted and each damping cartridge comprises inertial mass 50 and a cap 60 positioned in a lateral bore 30. Cap 60 may cooperate with lateral bore 30 to define an alternative form of bore chamber 82. The portion of bore chamber 82 not occupied by inertial mass 50 may be occupied by a fluid and or one or more elastomeric members (not shown). Cap 60 and lateral bore 30 may each include a recess for receiving a biasing member such as springs 65.

It may be desirable to tune the components of each damping device so as to achieve damping over a broader range of frequencies. In some embodiments, damping device 10 may be tuned to an eigenfrequency that matches one or more eigenfrequencies of the system to which it is mechanically coupled.

Parameters that can be adjusted as part of the tuning process may include but are not limited to: the mass, material, and configuration of inertial mass 50, the size and configuration of fluid passage 52 therethrough, the width and length of any shear gap, various coefficients of friction, preload, the distance between lateral bore 30 and axis 25, the number of damping cartridges 40, the properties of the optional biasing members, and the properties of any fluid and/or elastomeric members included in chambers 62, 82. Damping device 10 may be provided as an integral part of the BHA or one of its components, where all needed elements are integrated into readily available tools, or damping device 10 may be provided as a module or unit separate from the BHA.

Figure 12:
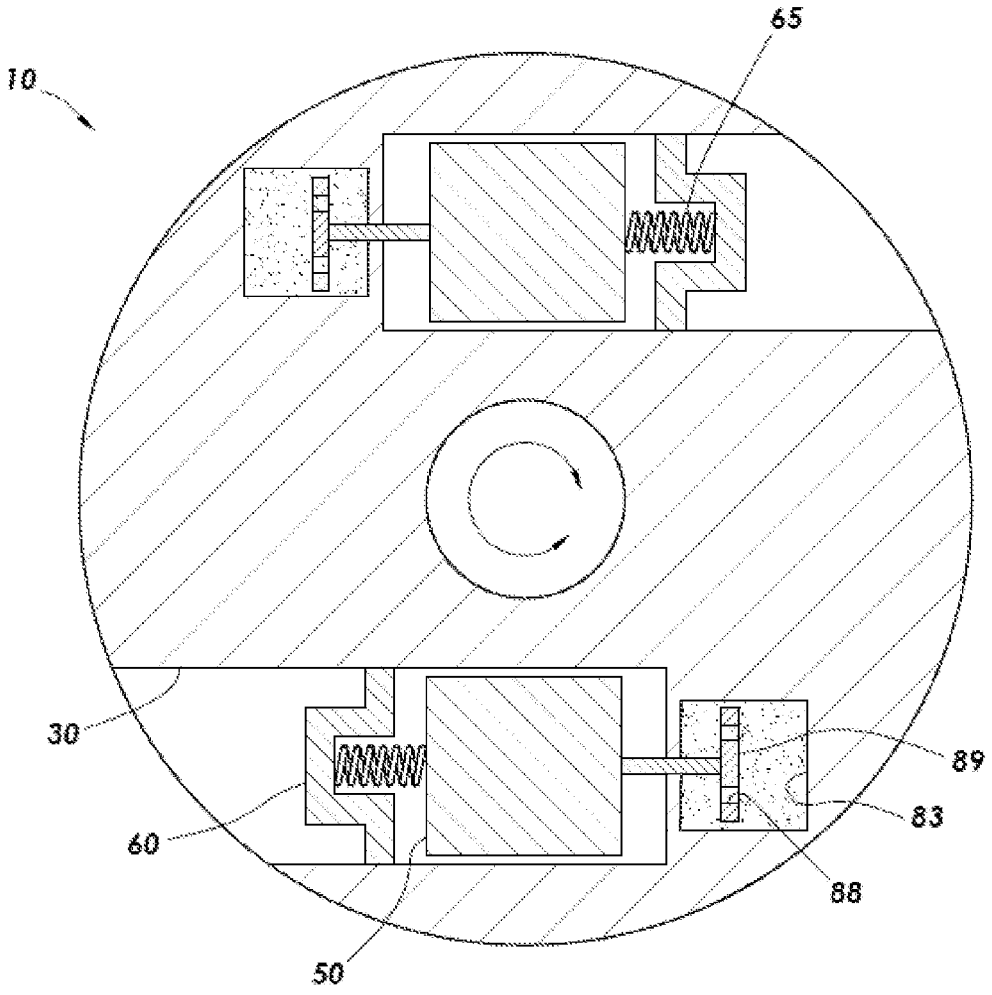
FIG. 12 is cross-section of a device in accordance with another alternative embodiment of the invention.

FIG. 12 shows another alternative embodiment, in which each lateral bore includes a fluid-filled piston chamber 83 at its inner end and each inertial mass 50 includes a piston 89 extending into piston chamber 83. As inertial mass 50 reciprocates within lateral bore 30, piston 89 reciprocates within piston chamber 83. Fluid in piston chamber 83 may flow through orifices 88 in piston 89 and/or may flow around the perimeter of piston 89. Movement of piston 89 through the fluid in piston chamber 83 results in frictional energy loss. As in FIG. 11, the portion of bore chamber 62 not occupied by inertial mass 50 may also be occupied by a fluid and or one or more elastomeric members (not shown). The fluid in piston chamber 83 may be the same or different from the fluid in bore chamber 62; if the fluids are different, piston 89 may extend through a sealed opening in the end wall of lateral bore 30. One or more biasing members such as springs 65 may be included between inertial mass 50 and/or cap 60 and lateral bore 30.

Referring again to FIGS. 2-7, a damping device 10 can be used to increase the reliability of an RSS and/or components of the RSS or BHA. Damping device 10 is especially advantageous in operations that have no designated vibration damping drill string component. Damping device 10 can be integrated into a drill string as a separate device, and/or as a separate device positioned within another drill string member (cartridge), or by integrating its components into a torque-transmitting member of the drill string.

It may be desirable to tune the components of each damping device so as to achieve damping over a broader range of frequencies. In some embodiments, damping device 10 may be tuned to an eigenfrequency that matches one or more eigenfrequencies of the system to which it is mechanically coupled.

In some embodiments, damping device 10 can be tuned to at least one torsional natural frequency of the tool or component it is intended to protect, which may include, for example, the BHA, RSS, or other components of the RSS. In these embodiments, the tool or component is modeled and its natural frequency(ies) is(are) calculated.

Figure 13:
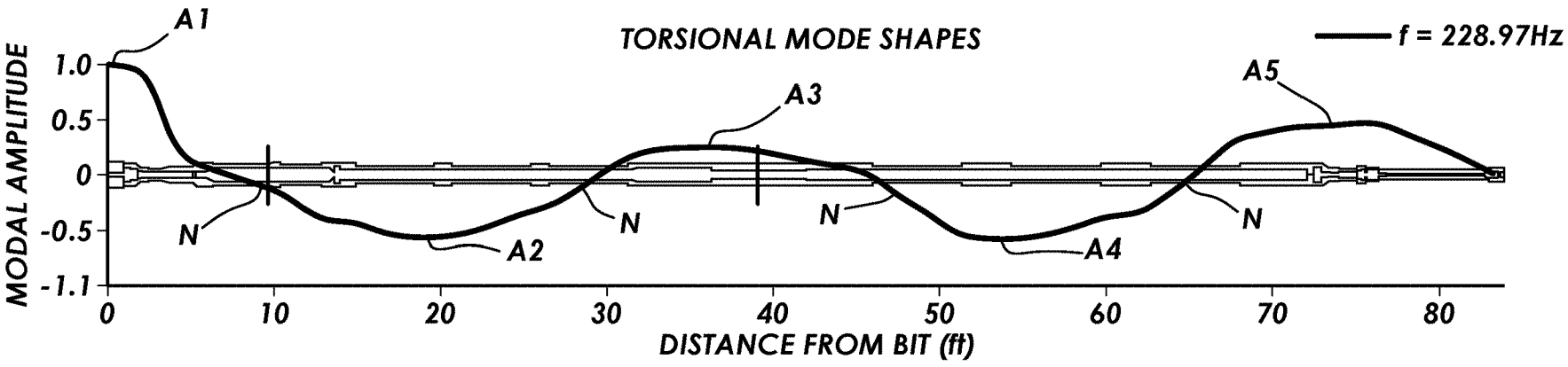
FIG. 13 is a schematic illustration of torsional vibrational nodes of part of a drill string.

According to some embodiments, damping device 10 can be adapted to a drill string or component thereof using the following steps:

a) Calculate the torsional natural frequencies, also referred to as Eigen Values or eigenfrequencies, and mode shapes (Eigen Vectors) based on the mechanical properties of the BHA (ODs, IDs, Lengths, and Material Properties). The calculation may be based on a finite elements analysis or the like. Boundary conditions may be selected such that the system being examined is free to rotate at one end and can be fixed, free, or weakly supported at the opposite end.

b) Tune the damping device characteristics to match the desired frequencies. Each damping device 10 will have frequency dependent damping properties; tuning entails adjusting the frequency dependent damping properties of the device to correspond to the at least one desired frequency. The frequency dependent damping properties can be adjusted by adjusting one or more parameters including the inertia (mass, material density, lever to axis of rotation, etc.) and damping characteristics (type of fluid, fluid viscosity, shear gap width, shear gap length, coefficient of friction, preload, etc.) of the damping device. In some instances, the target frequency may be from 30 Hz up to 1000 Hz. The tuning may be carried out empirically or using mathematical models.

c) Use the calculated mode shapes to select a location for the damping device. As illustrated schematically in FIG. 13, for a given tool and frequency, a mathematical model can be used to calculate the amplitude of vibration at each point along the tool. As illustrated in FIG. 13, the amplitude will tend to vary between antinodes A1, A2, A3 . . . , i.e. points along the Eigen Vector in which the amplitude is a local maximum or minimum, along the length of the tool, with a node N (zero value) between each pair of adjacent antinodes. Depending on the tool, the antinodes may increase or diminish in amplitude along the length of the tool, with the greatest amplitude (greatest maximum) being closest to one end of the tool.

Figure 14A:
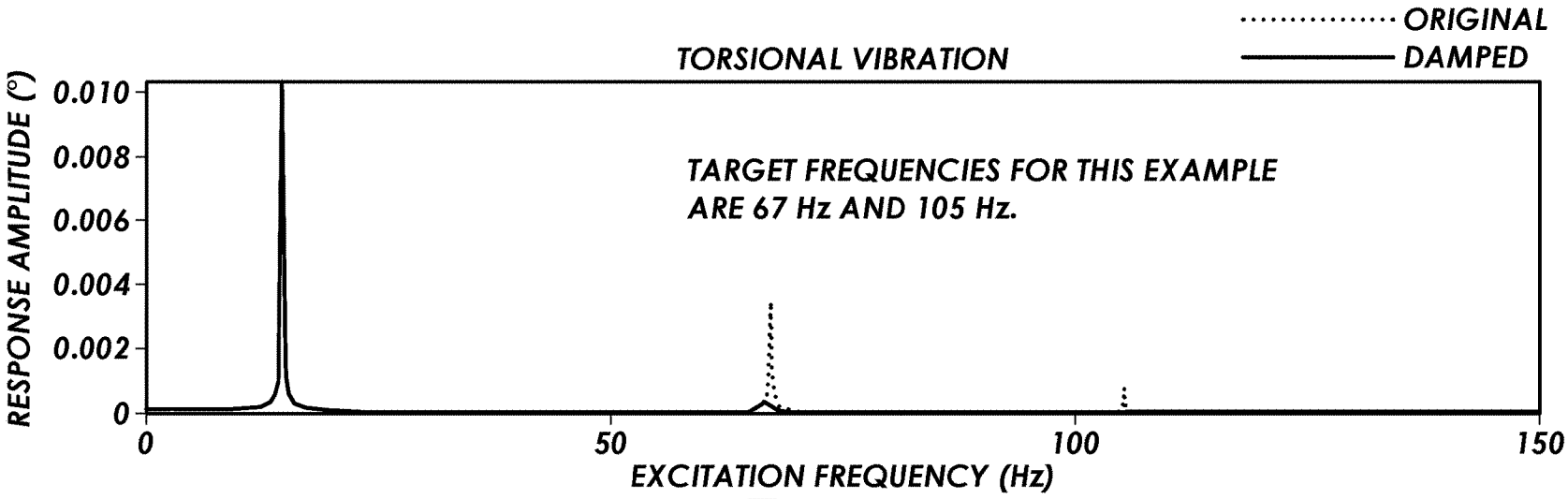
FIGS. 14A and 14B are plots of models illustrating damping of torsional vibration at target frequencies.
Figure 14B:
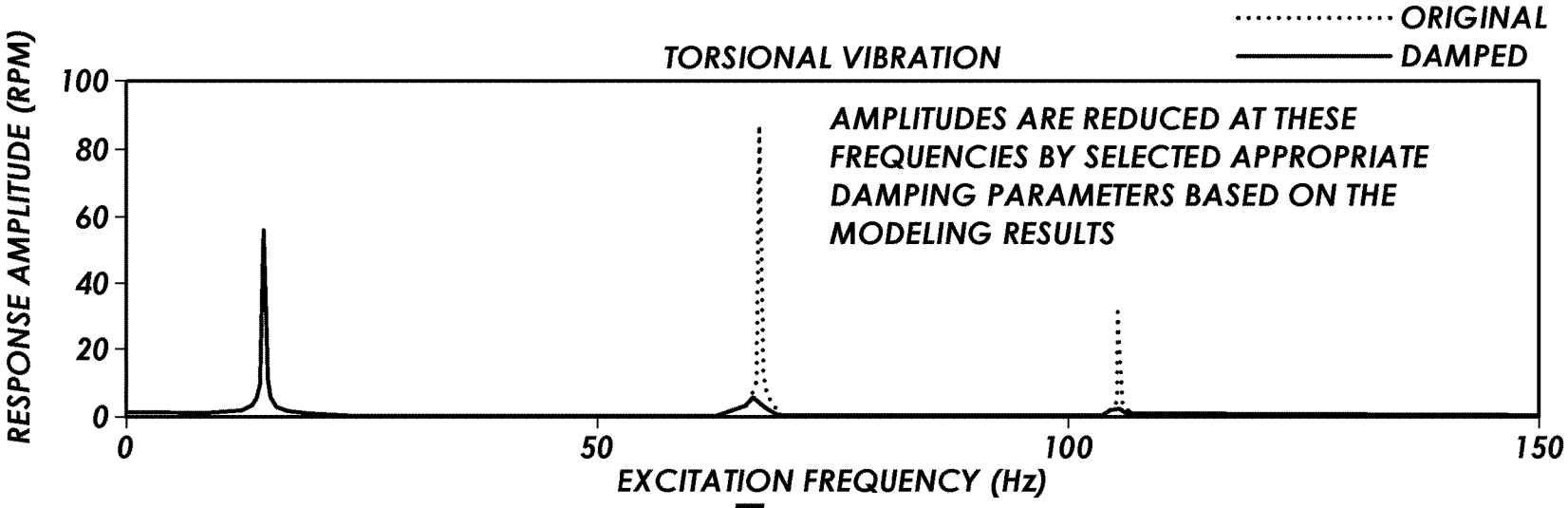

In some embodiments, it may be advantageous to position a damping device 10 at each of one or more anti-nodes. In some instances, it may be desirable to position a damping device 10 close to or at the point with the largest absolute value of modal displacement. FIG. 14 illustrates damping of torsional vibration measured in degrees (FIG. 14A) and rpm (FIG. 14B).

A system including one or more damping devices may be configured to damp vibrations at one or more frequencies. In some embodiments, damping devices tuned to different frequencies can be used to damp multiple (separate) frequencies. In other embodiments, a single damping device that is capable of damping a broad range of frequencies can be used. The effective frequency range of a damping device can be influenced by various parameters, as set out above.

The purpose of the present damping device is to protect the BHA, or certain parts of said BHA, from torsional vibrations that exceed detrimental magnitudes. In some instances, the device may be used for damping loads that occur during drilling operation, such as torque peaks and/or torsional accelerations/oscillations. A drilling system may include one or a plurality of said damping devices in different locations. The damping device can be an integral part of the BHA or one of its components, where all needed elements are integrated into readily available tools. It can also be added to the BHA as a separate device (module), where all elements are integrated into a tool on its own.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art may readily use the present disclosure as a basis for designing or modifying other processes and structures for carrying out the same purposes and/or achieving the same advantages of the embodiments introduced herein. One of ordinary skill in the art may make various changes, substitutions, and alterations without departing from the scope of the present disclosure.

What is claimed is:

1. A vibration damping device for use with a downhole tool, the downhole tool having a tool axis and including a drill string component, the vibration damping device comprising:

a body integral with or mechanically coupled to the drill string component, the body including a longitudinal bore therethrough and at least one lateral bore, the lateral bore having a bore opening and an end wall;

an inertial mass slidably disposed in the lateral bore; and a cap mechanically coupled to the lateral bore, wherein the cap encloses the bore opening so as to define a closed bore chamber that contains the inertial mass.

2. The device of claim 1 wherein the lateral bore is orthogonal to a radius of the body and lies in a plane normal to the tool axis.

3. The device of claim 1 wherein the body includes a plurality of lateral bores in a co-planar arrangement.

4. The device of claim 3 wherein the body includes a plurality of the co-planar arrangements.

5. The device of claim 1 wherein the body includes a plurality of lateral bores, and wherein each lateral bore is a blind hole and is positioned in the body so that it does not intersect the longitudinal bore or another lateral bore.

6. The device of claim 1, further including a first biasing means positioned between one end of the inertial mass and the lateral bore and a second biasing means positioned between another end of the inertial mass and the cap.

7. The device of claim 1 wherein a portion of the bore chamber that is not occupied by the inertial mass is occupied by a liquid.

8. The device of claim 1 wherein the inertial mass includes at least one fluid passage therethrough.

9. The device of claim 1 wherein each lateral bore further includes a fluid-filled piston chamber and each inertial mass includes a piston extending into the piston chamber.

10. The device of claim 9 wherein the piston chamber is sealed from the bore chamber, and wherein the fluid in the piston chamber is different from the fluid in the bore chamber.

11. A vibration damping device for use with a downhole tool, the downhole tool having a tool axis and including a drill string component, the vibration damping device comprising:

a body integral with or mechanically coupled to the drill string component, the body including a longitudinal bore therethrough and at least one lateral bore, the lateral bore having a bore opening and an end wall;

an inertial mass slidably disposed in the lateral bore; and a cap mechanically coupled to the lateral bore;

wherein the lateral bore is a stepped hole comprising a first bore section and a second bore section, wherein the second bore section defines the inner end of the lateral bore and has a smaller diameter than the first bore section, and wherein one end of the first biasing means is disposed in the second bore section.

12. A vibration damping device for use with a downhole tool, the downhole tool having a tool axis and including a drill string component, the vibration damping device comprising:

a body integral with or mechanically coupled to the drill string component, the body including a longitudinal bore therethrough and at least one lateral bore, the lateral bore having a bore opening and an end wall;

a cap mechanically coupled to the lateral bore;

a cartridge housing disposed in and mechanically coupled to the lateral bore, wherein the cap encloses the cartridge housing and defines a bore chamber therewith; and an inertial mass slidably disposed in the bore chamber.

13. The device of claim 12, further including a first biasing means positioned between one end of the inertial mass and the cartridge and a second biasing means positioned between another end of the inertial mass and the cap.

14. The device of claim 12 wherein a portion of the bore chamber that is not occupied by the inertial mass is occupied by a liquid.

15. A vibration damping device for use with a downhole tool, the downhole tool having a tool axis and including a drill string component, the vibration damping device comprising:

a body integral with or mechanically coupled to the drill string component, the body including a longitudinal bore therethrough and at least one lateral bore, the lateral bore having a bore opening and an end wall;

an inertial mass slidably disposed in the lateral bore; and a cap mechanically coupled to the lateral bore;

wherein each lateral bore further includes a fluid-filled piston chamber and each inertial mass includes a piston extending into the piston chamber, and wherein at least one piston includes orifices therethrough such that as the piston reciprocates within the piston chamber, fluid in the piston chamber flows through the orifices.

* * * * *